US009650737B2

(12) United States Patent
Lee et al.

(10) Patent No.: US 9,650,737 B2
(45) **Date of Patent: *May 16, 2017**

(54) LAUNDRY TREATING APPARATUS

(71) Applicant: LG ELECTRONICS INC., Seoul (KR)

(72) Inventors: Aram Lee, Seoul (KR); Soowon Park, Seoul (KR); Hyuntae Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/857,608

(22) Filed: Sep. 17, 2015

(65) Prior Publication Data

US 2016/0076187 A1 Mar. 17, 2016

(30) Foreign Application Priority Data

Sep. 17, 2014 (KR) ..... 10-2014-0123879

(51) Int. Cl.
*A47B 77/06* (2006.01)
*D06F 37/28* (2006.01)
(Continued)

(52) U.S. Cl.
CPC ..... *D06F 37/28* (2013.01); *D06F 39/14* (2013.01); *E05D 7/02* (2013.01); *E05D 7/1055* (2013.01)

(58) Field of Classification Search
CPC . D06F 37/28; D06F 39/14; E05D 7/02; E05D 7/1055
See application file for complete search history.

(56) References Cited

U.S. PATENT DOCUMENTS 2,487,745 A 11/1949 Witmer
2,982,540 A * 5/1961 Eppley ..... D06F 37/28 49/277
(Continued)

FOREIGN PATENT DOCUMENTS

AU 2011345515 6/2012
CN 103225194 7/2013
(Continued)

OTHER PUBLICATIONS

U.S. Appl. No. 14/619,459, filed Feb. 11, 2015.
(Continued)

*Primary Examiner* — Hanh V Tran
(74) *Attorney, Agent, or Firm* — KED & Associates, LLP

(57) ABSTRACT

A laundry treating apparatus includes a cabinet, a door, a first hinge including a first shaft and a first shaft receiving unit, a second hinge including a second shaft and a third shaft configured to rotatably fix the second shaft to the cabinet and to define a second rotational axis of the door, a third hinge including a fourth shaft and a fourth shaft receiving unit such that the fourth shaft is detachably received in the fourth shaft receiving unit, a first switching unit provided in the door, a second switching unit provided in the door, the second switching unit being configured to close the fourth shaft receiving unit, and a withdrawal prevention unit configured to detachably couple second switching unit to the third hinge when the second switching unit closes the fourth shaft receiving unit.

10 Claims, 13 Drawing Sheets

(51) Int. Cl.

| | |
|---|---|
| ***D06F 39/14*** | (2006.01) |
| ***E05D 7/02*** | (2006.01) |
| ***E05D 7/10*** | (2006.01) |

(56) References Cited

U.S. PATENT DOCUMENTS

| | | | | |
|---|---|---|---|---|
| 3,018,508 | A * | 1/1962 | Keeling, Sr. | E05D 15/52 126/194 |
| 3,018,509 | A * | 1/1962 | Sherman | E05D 15/52 126/194 |
| 3,030,656 | A * | 4/1962 | Hopkins | E05D 15/52 16/224 |
| 3,538,641 | A | 11/1970 | Miller et al. | |
| 3,802,124 | A | 4/1974 | Guerrini | |
| 3,909,877 | A | 10/1975 | Christy et al. | |
| 4,035,953 | A * | 7/1977 | Bierlich | E05D 15/5211 49/192 |
| 4,445,717 | A | 5/1984 | Imhoff | |
| 4,532,673 | A * | 8/1985 | Kim | E05D 15/50 16/230 |
| 5,829,197 | A * | 11/1998 | Oh | E05D 15/505 16/231 |
| 7,243,973 | B2 * | 7/2007 | Plett | B62D 33/0273 296/57.1 |
| 7,481,479 | B1 * | 1/2009 | Townson | B62D 33/0273 16/223 |
| 7,547,056 | B2 * | 6/2009 | Waldner | B62D 33/0273 16/231 |
| 9,371,608 | B2 * | 6/2016 | Cho | D06F 39/14 |
| 9,435,068 | B2 * | 9/2016 | Kang | D06F 39/12 |
| 2006/0123855 | A1 | 6/2006 | Erickson | |
| 2008/0109987 | A1 | 5/2008 | Chen et al. | |
| 2010/0175221 | A1 * | 7/2010 | Klassen | E05D 7/1005 16/229 |
| 2010/0295428 | A1 | 11/2010 | Favaro et al. | |
| 2012/0161594 | A1 | 6/2012 | Kim et al. | |
| 2012/0187811 | A1 * | 7/2012 | Kim | E05D 3/10 312/228 |
| 2012/0217851 | A1 | 8/2012 | Bae et al. | |
| 2013/0193823 | A1 * | 8/2013 | Cho | D06F 39/14 312/319.2 |

FOREIGN PATENT DOCUMENTS

| | | | |
|---|---|---|---|
| CN | 103314151 | | 9/2013 |
| CN | 104846585 | | 8/2015 |
| CN | 204825396 | | 12/2015 |
| CN | 204825403 | | 12/2015 |
| EP | 2 620 538 | A2 | 7/2013 |
| EP | 2 657 393 | A2 | 10/2013 |
| EP | 2 907 910 | A1 | 8/2015 |
| JP | S 48-074044 | | 10/1973 |
| JP | S64-043182 | U | 3/1989 |
| JP | H 08-164294 | | 6/1996 |
| JP | H08-270308 | A | 10/1996 |
| JP | 2007-329241 | A | 12/2007 |
| JP | 4668848 | | 4/2011 |
| JP | 2013-203168 | | 10/2013 |
| JP | 2014-501141 | A | 1/2014 |
| JP | 2014-504194 | | 2/2014 |
| KR | 10-2012-0134367 | | 12/2012 |
| KR | 10-2013-0071844 | A | 7/2013 |
| WO | WO 2012/087055 | A2 | 6/2012 |

OTHER PUBLICATIONS

U.S. Appl. No. 14/619,526, filed Feb. 11, 2015.
U.S. Appl. No. 14/619,638, filed Feb. 11, 2015.
U.S. Appl. No. 14/857,571, filed Sep. 17, 2015.
U.S. Appl. No. 15/231,336, filed Aug. 8, 2016.
Australian Office Action dated May 5, 2016 issued in Application No. 2015227423.
Korean Notice of Allowance dated Jun. 30, 2016 issued in Application No. 10-2014-0123879.
United States Office Action dated Feb. 3, 2016 issued in U.S. Appl. No. 14/619,459.
United States Office Action dated Feb. 9, 2016 issued in U.S. Appl. No. 14/619,638.
Australian Office Action dated Mar. 11, 2016 issued in Application No. 2015227451.
U.S. Office Action dated May 23, 2016 issued in co-pending U.S. Appl. No. 14/619,638.
U.S. Office Action dated Jun. 10, 2016 issued in U.S. Appl. No. 14/619,526.
European Search Report dated May 15, 2015 issued in Application No. 15154939.1.
European Search Report dated May 15, 2015 issued in Application No. 15154937.5.
European Search Report dated May 15, 2015 issued in Application No. 15154938.3.
European Search Report dated Nov. 17, 2015 issued in Application No. 15184030.3.
U.S. Final Office Action dated Dec. 20, 2016 issued in U.S. Appl. No. 14/619,638.
Chinese Office Action dated Jul. 28, 2016 issued in Application No. 201510076064.4 (with English translation).
Chinese Office Action dated Jul. 28, 2016 issued in Application No. 201510076081.8 (with English translation).
U.S. Final Office Action dated Aug. 30, 2016 issued in co-pending U.S. Appl. No. 14/619,638.
U.S. Final Office Action dated Sep. 1, 2016 issued in co-pending U.S. Appl. No. 15/231,336.
Chinese Office Action dated Feb. 3, 2017 issued in Application No. 201510583609.0 (with English translation).
U.S. Office Action dated Mar. 13, 2017 issued in co-pending U.S. Appl. No. 14/857,571.

* cited by examiner (a)

(b)

(a)

(b)

(a)

(b)

(a)

(b)

(a)

(b)

(a)

(b)

(a)

(b)

LAUNDRY TREATING APPARATUS

CROSS-REFERENCE TO RELATED APPLICATION

This application claims the benefit of Korean Patent Application No. 10-2014-0123879, filed on Sep. 17, 2014, which is hereby incorporated by reference as if fully set forth herein.

BACKGROUND OF THE INVENTION

Field of the Invention

The present invention relates to a laundry treating apparatus.

Discussion of the Related Art

In general, a laundry treating apparatus is a generic name for electric home appliances that are capable of washing, drying, or washing and drying laundry.

The laundry treating apparatus removes contaminants from laundry through the action of water and detergent to wash the laundry. On the other hand, the laundry treating apparatus removes moisture from laundry through a heated air supply device provided in the laundry treating apparatus to dry the laundry.

A conventional laundry treating apparatus includes a cabinet forming the external appearance thereof, a laundry receiving space provided in the cabinet to receive laundry, an introduction port provided at the cabinet such that the introduction port communicates with the laundry receiving space, and a door to open and close the introduction port.

In the conventional laundry treating apparatus, the door is generally configured to rotate about one vertical axis defined in a height direction of the cabinet.

SUMMARY OF THE INVENTION

Accordingly, the present invention is directed to a laundry treating apparatus that substantially obviates one or more problems due to limitations and disadvantages of the related art.

An object of the present invention is to provide a laundry treating apparatus configured such that a door is rotated in different directions to open an introduction port, through which laundry is introduced.

Another object of the present invention is to provide a laundry treating apparatus that enables a user to switch between rotational axes of a door.

A further object of the present invention is to provide a laundry treating apparatus that prevents switching between rotational axes of a door while the door opens an introduction port.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus includes a cabinet having an introduction port, a laundry receiving unit located in the cabinet to receive laundry introduced through the introduction port, a door configured to open and close the introduction port, a first hinge including a first shaft provided at either one selected from between the cabinet and the door to define a first rotational axis of the door and a first shaft receiving unit provided at the other one selected from between the cabinet and the door such that the first shaft is detachably received in the first shaft receiving unit, a second hinge including a second shaft coupled to the door to define the first rotational axis together with the first shaft and a third shaft configured to rotatably fix the second shaft to the cabinet and to define a second rotational axis of the door, a third hinge including a fourth shaft provided at either one selected from between the cabinet and the door to define the second rotational axis together with the third shaft and a fourth shaft receiving unit provided at the other one selected from between the cabinet and the door such that the fourth shaft is detachably received in the fourth shaft receiving unit, a first switching unit provided in the door in a reciprocating fashion to open and close the first shaft receiving unit, a second switching unit provided in the door in a reciprocating fashion to open and close the fourth shaft receiving unit, the second switching unit being configured to close the fourth shaft receiving unit when the first switching unit moves in a direction in which the first shaft receiving unit is opened, and a withdrawal prevention unit configured to detachably couple the second switching unit to the third hinge when the second switching unit closes the fourth shaft receiving unit.

The third hinge may further include a switching unit receiving unit, into which a free end of the second switching unit to close the fourth shaft receiving unit is inserted, and the withdrawal prevention unit may include a first withdrawal prevention unit provided at either one selected from between the second switching unit and the switching unit receiving unit and a second withdrawal prevention unit provided at the other one selected from between the second switching unit and the switching unit receiving unit such that the second withdrawal prevention unit is detachably coupled to the first withdrawal prevention unit.

The first withdrawal prevention unit may be configured as a groove formed in the outer circumference of the second switching unit, and the second withdrawal prevention unit may be configured as a protrusion, which is inserted into the groove.

The laundry treating apparatus may further include a manipulation unit configured to move the first switching unit, a first lock configured to fix the position of the first switching unit when the door opens the introduction port, and a second lock configured to fix the position of the second switching unit when the door opens the introduction port.

The second lock may be configured to be separated from the second switching unit when the door closes the introduction port and to be coupled to the second switching unit when the door opens the introduction port.

The second lock may include a second lock body configured to reciprocate in the door in a thickness direction of the door, a second lock transfer unit configured to move the second lock body in a direction in which the second lock body becomes more distant from the introduction port when the door closes the introduction port, a second lock support unit configured to elastically support the second lock body such that the second lock body is pushed toward the introduction port, and a second lock fastening unit configured to separate the second lock body from the second switching unit when the door closes the introduction port and to connect the second lock body to the second switching unit when the door opens the introduction port.

The second lock fastening unit may include a first fastening unit provided at the second switching unit and a second fastening unit provided at the second lock body such that the second fastening unit is coupled to the first fastening unit.

Alternatively, the second lock fastening unit may include a first fastening unit and a second fastening unit provided at the second switching unit, the first fastening unit and the second fastening unit being spaced apart from each other by a predetermined distance in a direction in which the second switching unit is moved, a second lock flange protruding from the second lock body toward the second switching unit, and a third fastening unit provided at the second lock flange such that the third fastening unit is coupled to either one selected from between the first fastening unit and the second fastening unit based on the position of the second switching unit.

The first lock may include a first lock body configured to reciprocate in a width direction of the door, the first lock body being detachably provided at the manipulation unit, a first lock support unit configured to elastically support the first lock body, and a first lock transfer unit configured to separate the first lock body from the manipulation unit when the door closes the introduction port and to couple the first lock body to the manipulation unit when the door opens the introduction port.

Alternatively, the first lock may include a first lock body configured to reciprocate in the door in a thickness direction of the door, a second lock transfer unit configured to move the first lock body in a direction in which the first lock body becomes more distant from the introduction port while contacting the cabinet when the door closes the introduction port, a first lock support unit configured to elastically support the first lock body such that the first lock body is pushed toward the introduction port, a first fixing unit and a second fixing unit spaced apart from each other by a predetermined distance in a direction in which the first switching unit is moved, a first lock flange provided at the first lock body, and a third fixing unit provided at the first lock flange such that the third fixing unit is coupled to either one selected from between the first fixing unit and the second fixing unit based on the position of the first switching unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. It should be noted herein that construction of an apparatus, which will hereinafter be described, and a control method of the apparatus are given only for illustrative purposes and the protection scope of the invention is not limited thereto. Wherever possible, the same reference numbers will be used throughout the drawings to refer to the same or like parts.

Figure 1:
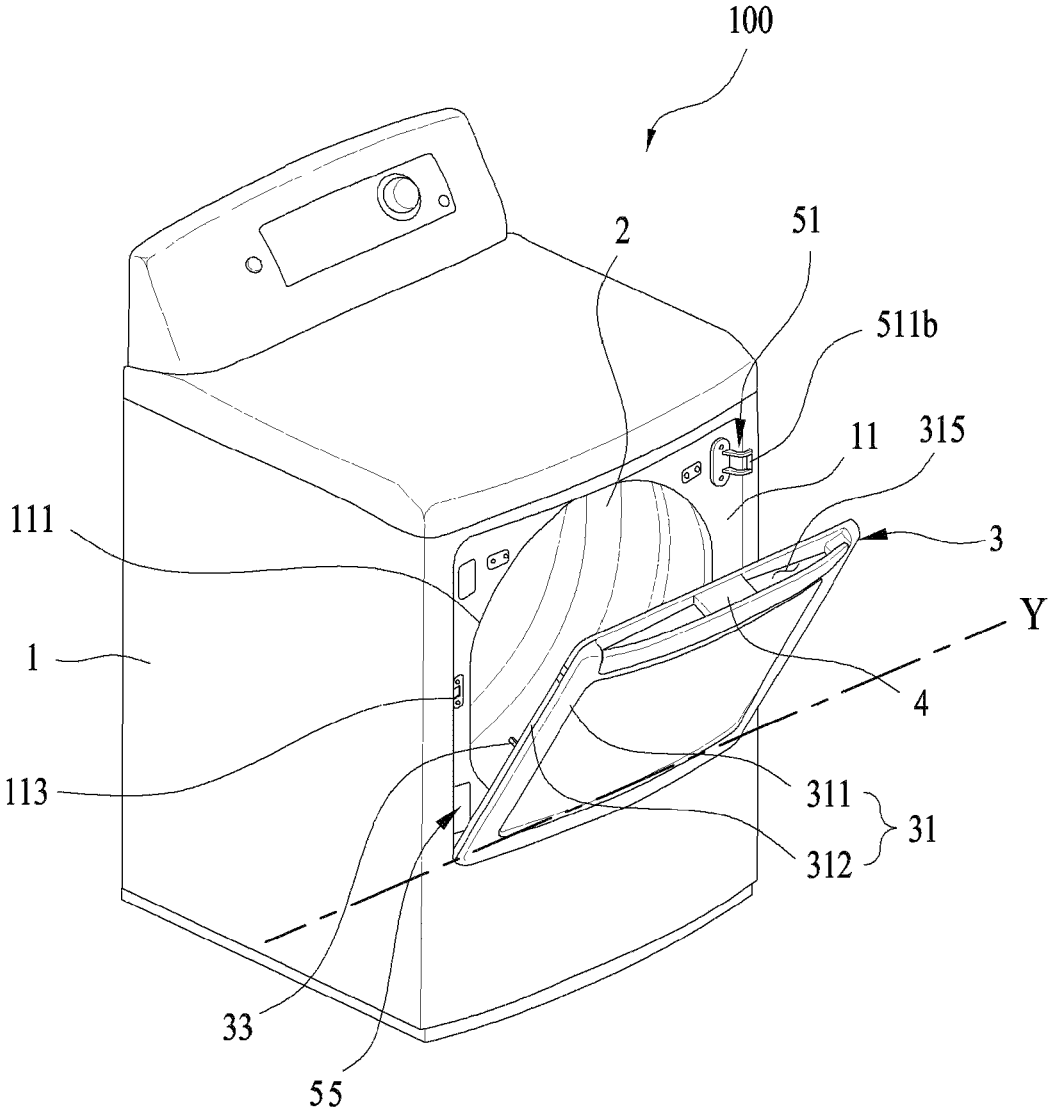
FIG. 1 is a view showing a case in which a door is rotated about a second rotational axis to open an introduction port.

As shown in FIG. 1, a laundry treating apparatus 100 according to the present invention includes a cabinet 1 forming the external appearance thereof, a laundry receiving unit 2 provided in the cabinet 1 to define a space to receive laundry, and a door 3 provided at the cabinet 1 to open and close the laundry receiving unit 2.

The cabinet 1 includes a front panel 11 having an introduction port 111. The door 3 is provided at the front panel 11 to open and close the introduction port 111. Consequently, a user may open the introduction port 111 through the door 3 to introduce laundry (laundry to be washed or laundry to be dried) into the laundry receiving unit 2 or remove the laundry from the laundry receiving unit 2.

In a case in which the laundry treating apparatus 100 according to the present invention is a washing machine, the laundry receiving unit 2 may include a tub provided in the cabinet 1 to store wash water and a drum rotatably provided in the tub to define a space to receive laundry. In this case, the tub may have a tub introduction port communicating with the introduction port 111, and the drum may have a drum introduction port communicating with the introduction port 111.

In addition, the laundry treating apparatus 100 may further include a wash water supply unit (not shown) to supply wash water to the tub and a wash water discharge unit (not shown) to discharge wash water stored in the tub out of the cabinet 1.

On the other hand, in a case in which the laundry treating apparatus 100 according to the present invention is a drying machine, the laundry receiving unit 2 may include only a drum rotatably provided in the cabinet 1. In this case, the laundry treating apparatus 100 may further include an air supply unit (not shown) provided in the cabinet 1 to supply heated air to the drum and to discharge the air supplied to the drum out of the drum.

In addition, the laundry treating apparatus 100 according to the present invention may be an all-in-one washing and drying machine. In this case, the laundry receiving unit 2 may include a tub, a drum, and an air supply unit (not shown) provided in the cabinet 1 to supply heated air to the wash water supply unit, the wash water discharge unit, and the tub and to discharge the air in the tub out of the tub.

The door 3, which is provided at the front panel 11 to open and close the introduction port 111, may be rotatable about two different rotational axes X and Y. The door 3 may be coupled to the front panel 11 via a hinge unit 51, 53, and 55. The user may switch between the rotational axes X and Y of the door 3 using a manipulation unit 4.

The door 3 may include a door body 31 to open and close the introduction port 111 and a door lock 33 to fix the door body 31 to the front panel 11.

The door body 31 may include an outer frame 311 forming the outer circumferential surface of the laundry treating apparatus 100 and an inner frame 312 coupled to the outer frame 311, the inner frame 312 being disposed on the surface of the outer frame 311 that faces the front panel 11.

The door lock 33 may be provided at the surface of the inner frame 312 in a protruding fashion. In this case, the front panel 11 may further include a door lock fastening unit 113 to receive the door lock 33.

Meanwhile, the structure of the door lock 33 and the door lock fastening unit 113 to detachably fix the door body 31 to the front panel 11 is not particularly restricted.

The door body 31 may be provided with a receiving unit 315. FIG. 1 shows a case in which the receiving unit 315 is configured as a groove formed in the upper portion of the door body 31 by way of example. In this case, the manipulation unit 4 may be disposed in the groove.

Figure 2:
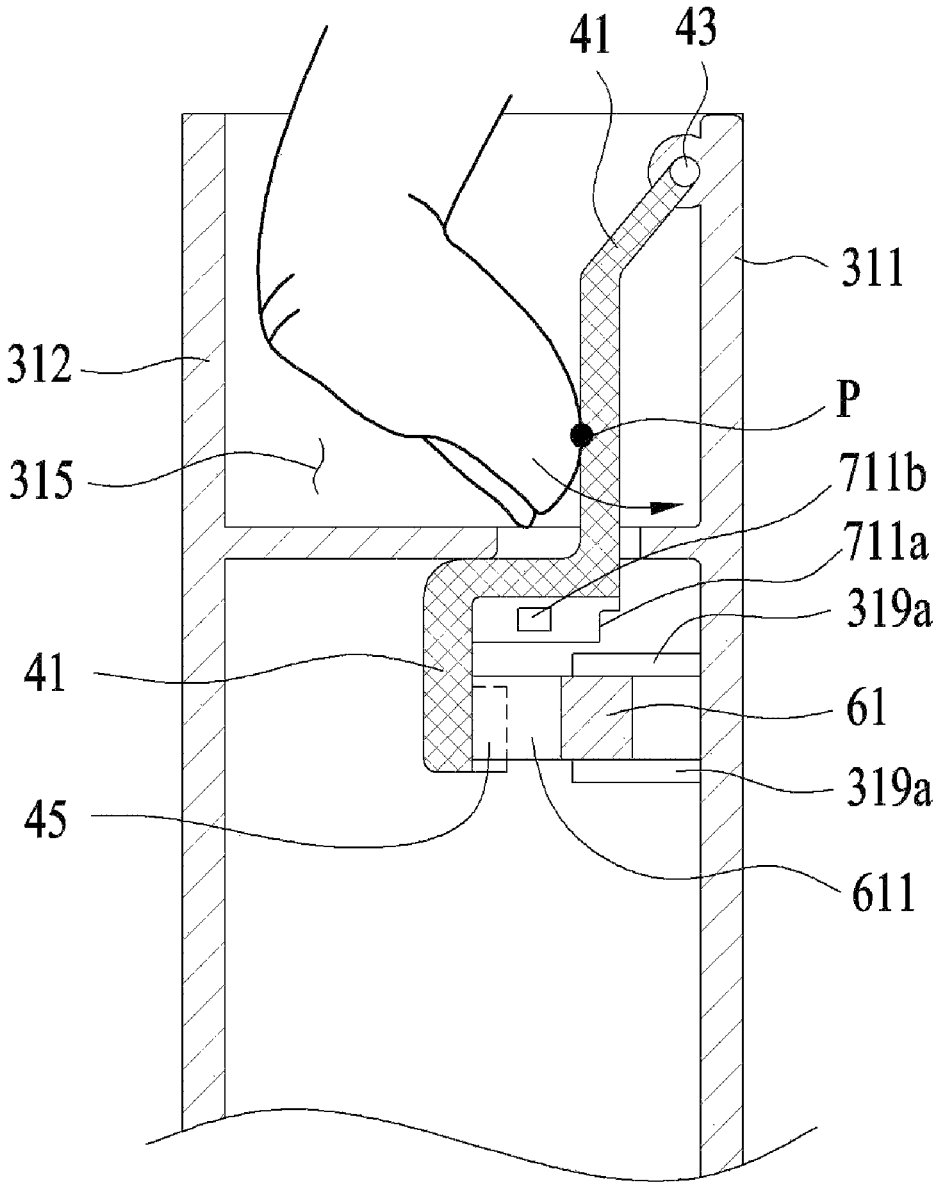
FIG. 2 is a view showing a manipulation unit of a laundry treating apparatus according to the present invention.

As shown in FIG. 2, the manipulation unit 4 may include a handle body 41 provided in the receiving unit 316, a body rotation shaft 43 to rotatably couple the handle body 41 to the door body 31, and a transfer unit 45 to operate a rotational axis switching unit 6 according to the operation of the handle body 41. The rotational axis switching unit 6 is a means provided in the door body 31 to allow the user to switch between the rotational axes X and Y, which will hereinafter be described in detail.

FIG. 2 shows a case in which the body rotation shaft 43 is positioned above a contact point P. Alternatively, the body rotation shaft 43 may be positioned below the contact point P.

Figure 3:
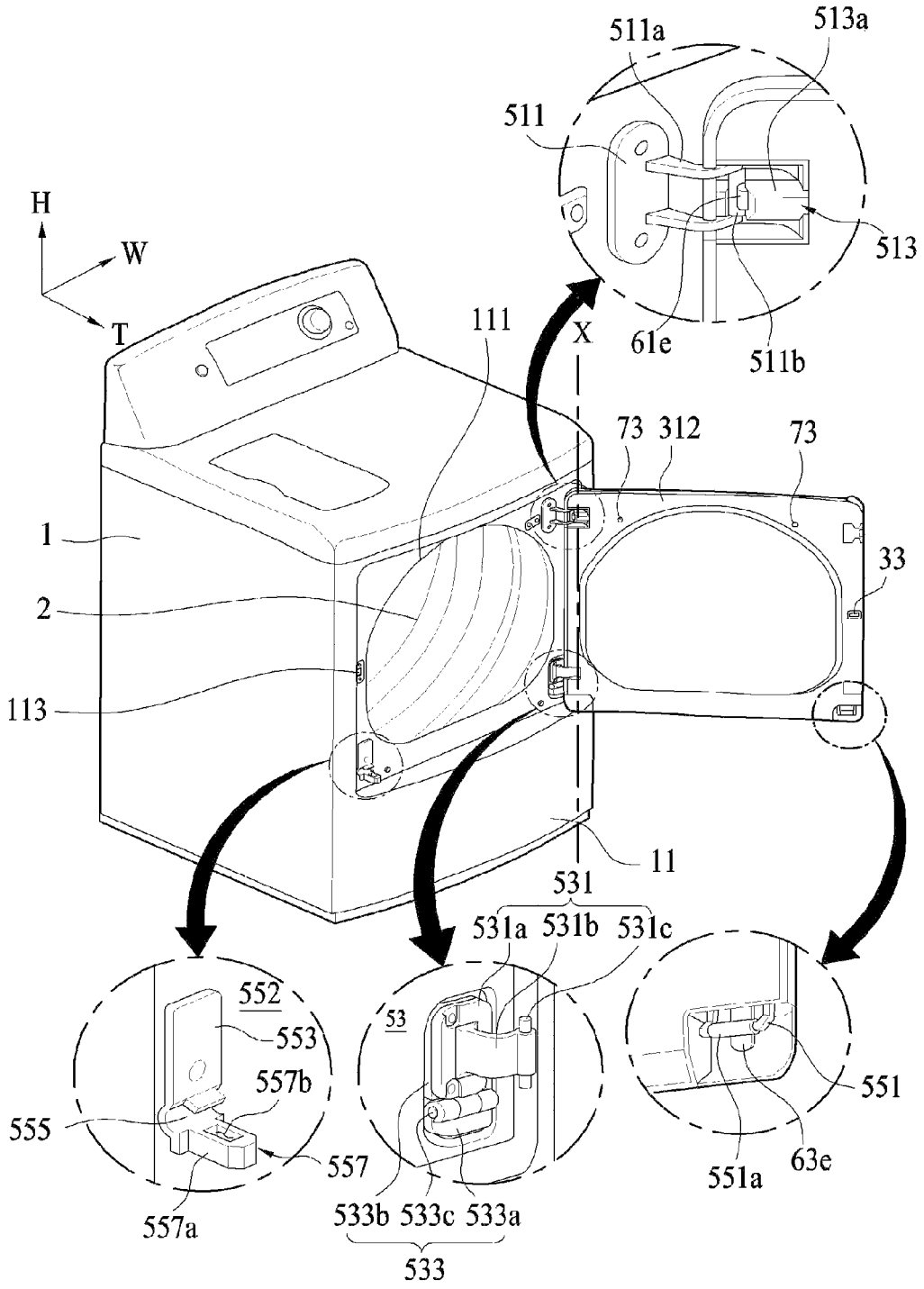
FIG. 3 is a view showing a case in which the door is rotated about a first rotational axis to open the introduction port.

As shown in FIG. 3, the hinge unit 51, 53, and 55 to couple the door body 31 to the front panel 11 may include a first hinge 51 having a first shaft 511*b*, a third hinge 55 having a fourth shaft 551*a*, and a second hinge 53 having a second shaft 531*c* defining the first rotational axis X together with the first shaft 511*b* and a third shaft 533*c* defining the second rotational axis Y (see FIG. 1) together with the fourth shaft 551*a*.

The first hinge 51 may include a first hinge body 511 provided at either one selected from between the front panel 11 and the door body 31 such that the first shaft 511*b* is fixed to the first hinge body 511 and a first shaft attaching and detaching unit 513 provided at the other one selected from between the front panel 11 and the door body 31 such that the first shaft attaching and detaching unit 513 is detachably coupled to the first shaft 511*b*.

FIG. 3 shows a case in which the first hinge body 511 is fixed to the front panel 11, and the first shaft attaching and detaching unit 513 is provided at the door body 31, by way of example.

In this case, the first hinge body 511 is provided with a shaft support unit 511*a* to support the first shaft 511*b*. The shaft support unit 511*a* may protrude from the front panel 11, and may then be bent in a direction in which the shaft support unit 511*a* moves away from the introduction port 111 along a plane parallel to the front panel. Alternatively, the shaft support unit 511*a* may merely protrude from the front panel 11.

The first shaft attaching and detaching unit 513 includes a housing 513*a* provided at the door body 31 and a first shaft receiving unit 513*b* (see FIG. 5) provided in the housing 513*a* to define a space to receive the first shaft 511*b*. In this case, the first shaft receiving unit 513*b* may be exposed outside the inner frame 312.

Meanwhile, the housing 513*a* is provided with a switching unit through hole 513*c* (see FIG. 5) formed through the housing 513*a* such that a first switching unit 61 of the rotational axis switching unit 6 is inserted through the switching unit through hole 513*c*.

When the first switching unit 61 is reciprocated by the manipulation unit 4 in a width direction W of the door body 31, therefore, a first free end 61*e* of the first switching unit 61 may be exposed from the switching unit through hole 513*c* to close the first shaft receiving unit 513*b*, or may be located in the switching unit through hole 513*c* to open the first shaft receiving unit 513*b*.

When the first shaft receiving unit 513*b* is closed by the first free end 61*e* of the first switching unit 61, the first shaft 511*b* is prevented from being withdrawn from the first shaft receiving unit 513*b* and from being inserted into the first shaft receiving unit 513*b*.

When the first shaft receiving unit 513*b* is opened by the first free end 61*e* of the first switching unit 61, on the other hand, the first shaft 511*b* may be withdrawn from the first shaft receiving unit 513*b*, or may be inserted into the first shaft receiving unit 513*b*.

The second hinge 53 may include a door support unit 531, the door support unit 531 being provided with the second shaft 531*c*, and a cabinet coupling unit 533 to rotatably fix the door support unit 531 to the front panel 11 via the third shaft 533*c*.

The cabinet coupling unit 533 may include a coupling unit body 533*a* fixed to the front panel 11 and a rotary plate 533*b* rotatably coupled to the coupling unit body 533*a* via the third shaft 533*c*.

In this case, the door support unit 531 may include a support unit body 531*a* fixed to the rotary plate 533*b* and a shaft support unit 531*b* protruding from the support unit body 531*a* such that the second shaft 531*c* is supported by the shaft support unit 531*b*.

The second shaft 531*c* is rotatably fixed to the door body 31 and, in addition, is aligned with the first shaft 511*b* of the first hinge 51. As a result, the first rotational axis X is defined by the first shaft 511*b* and the second shaft 531*c*.

The third hinge 55 may include a fourth shaft 551*a* provided at either one selected from between the door body 31 and the front panel 11 and a fourth shaft attaching and detaching unit 552 provided at the other one selected from between the door body 31 and the front panel 11 such that the fourth shaft 551*a* is detachably coupled to the fourth shaft attaching and detaching unit 552. FIG. 3 shows a case in which the fourth shaft 551*a* is provided at the door body 31, and the fourth shaft attaching and detaching unit 552 is provided at the front panel 11, by way of example.

The fourth shaft 551*a* is supported by a third hinge body 551 fixed to the door body 31, and the fourth shaft 551*a* supported by the third hinge body 551 is exposed out of the inner frame 312.

The fourth shaft attaching and detaching unit 552 may include an attaching and detaching unit body 553 fixed to the front panel 11, a fourth shaft receiving unit 555 provided at the attaching and detaching unit body 553 to define a space to receive the fourth shaft 551*a*, and a switching unit receiving unit 557 protruding from the attaching and detaching unit body 553 to receive a second switching unit 63 of the rotational axis switching unit 6, which will hereinafter be described.

The fourth shaft receiving unit 555 may be configured as a receiving groove formed in the attaching and detaching unit body 553. The fourth shaft receiving unit 555 is aligned with the third shaft 553*c* of the second hinge 53. As a result, the fourth shaft 551*a* inserted into the fourth shaft receiving unit 555 defines the second rotational axis Y together with the third shaft 533*c*.

The switching unit receiving unit 557 may include a flange 557*a* protruding from the attaching and detaching unit body 553 in a state in which the second flange 557*a* is located below the fourth shaft receiving unit 555 and a flange through hole 557*b* formed through the flange 557*a* such that a first free end 63*e* of the second switching unit 63, reciprocated by the first switching unit 61 in a height direction H of the door body 31, is inserted through the flange through hole 557*b*.

Figure 4:
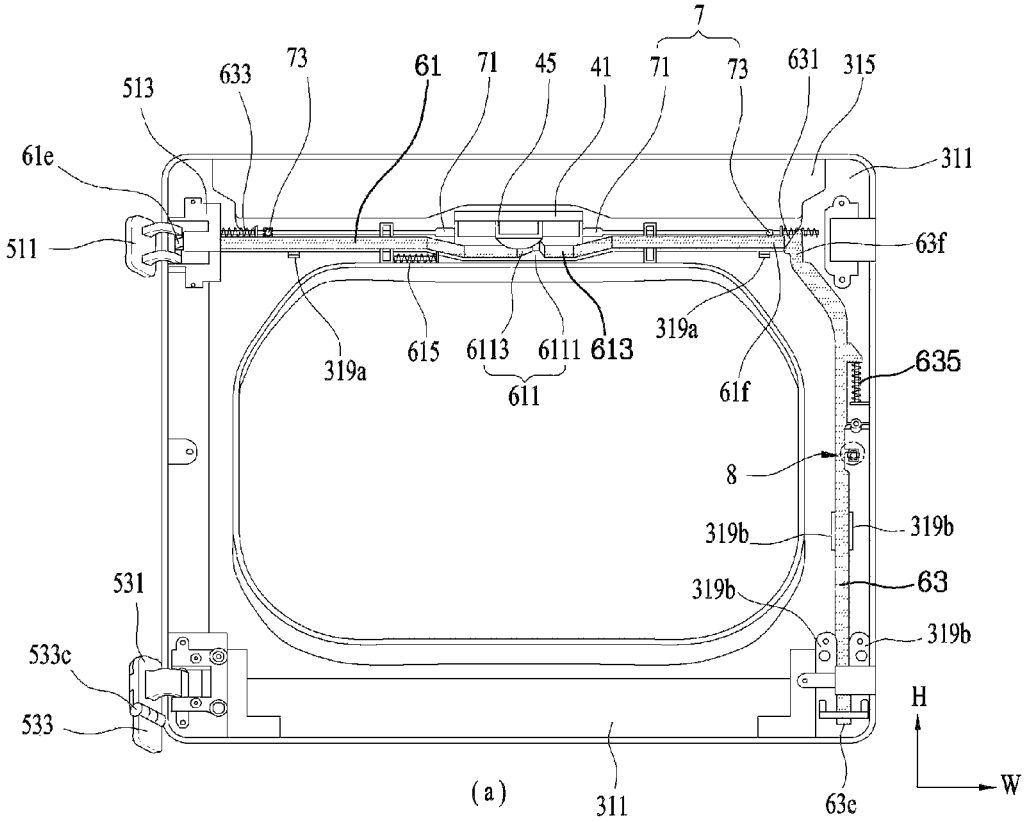
FIGS. 4 to 6 are views showing a rotational axis switching unit, a first lock, and a second lock provided in the door.
Figure 4:
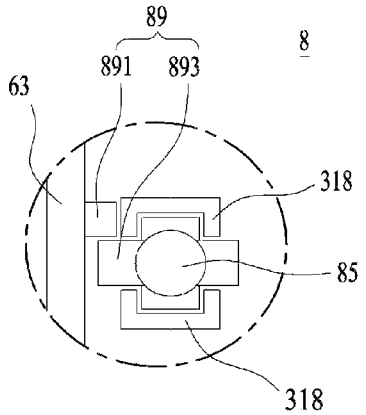

Meanwhile, as shown in FIG. 4, the rotational axis switching unit 6 is provided in the door body 31 to allow the user to select one of the rotational axes X and Y.

The rotational axis switching unit 6 may include the first switching unit 61, which is reciprocated by the manipulation unit 4 in the width direction W of the door body 31, and the second switching unit 63, which is reciprocated by the first switching unit 61 in the height direction H of the door body 31.

The first switching unit 61 may be configured as a bar disposed above the introduction port 111. In this case, the first free end 61*e* of the first switching unit 61 is inserted through the switching unit through hole 513*c* such that the free end 61*e* of the first switching unit 61 extends through the first shaft attaching and detaching unit 513. A second free end 61*f* of the first switching unit 61 contacts a second free end (a fourth free end) 63*f* of the second switching unit 63.

The first switching unit 61 is supported by a first switching unit guide 319*a* provided at at least one selected from between the outer frame 311 and the inner frame 312. FIG. 4 shows a case in which the first switching unit guide 319*a* is provided at the outer frame 311 to guide the movement of the first switching unit 61 by way of example.

The first switching unit 61 is provided with a contact unit 611. The contact unit 611 is a means for contacting the transfer unit 45, when the manipulation unit 4 is rotated, to move the first switching unit 61 in a direction in which the second switching unit 63 is positioned (in the rightward direction of FIG. 4).

To this end, the contact unit 611 may include a contact unit body 6111 protruding from the first switching unit 61 toward the inner frame 312 and a tilted surface 6113 provided at the contact unit body 6111 such that the tilted surface 6113 contacts the transfer unit 45.

In this case, the tilted surface 6113 may be tilted away from the first free end 61*e* of the first switching unit 61 as the tilted surface 6113 becomes more distant from the first switching unit 61 (i.e. as the tilted surface 6113 becomes closer to the inner frame 312).

When the user pushes the handle body 41, therefore, the transfer unit 45 pushes the tilted surface 6113. Consequently, it is possible to move the first switching unit 61 in the direction in which the second switching unit 63 is positioned using the manipulation unit 4. That is, it is possible to manipulate the manipulation unit 4 such that the first shaft receiving unit 513*b* is opened or closed by the first free end 61*e* of the first switching unit 61.

Meanwhile, the contact unit 611 is provided in the door body 31, which has a limited thickness. For this reason, the first switching unit 61 may further include a bent unit 613 bent toward the outer frame 311. In this case, the contact unit 611 may be provided at the bent unit 613.

The second switching unit 63 may be configured as a bar extending in the height direction H of the door body 31. A first free end (a third free end) 63*e* of the second switching unit 63 is located in a space between the fourth shaft 551*a* and the outer frame 311, and a second free end (a fourth free end) 63*f* of the second switching unit 63 contacts the second free end 61*f* of the first switching unit 61.

In order to easily transfer external force applied to the first switching unit 61 through the manipulation unit 4 to the second switching unit 63, at least one selected from between the second free end 61*f* of the first switching unit 61 and the second free end 63*f* of the second switching unit 63 may be further provided with a tilted switching unit surface 631. FIG. 4 shows a case in which the tilted switching unit surface 631 is provided at the second switching unit 63 by way of example.

The second switching unit 63 is supported by a second switching unit guide 319*b* provided at at least one selected from between the outer frame 311 and the inner frame 312. FIG. 4 shows a case in which the second switching unit guide 319*b* is provided at the outer frame 311 to guide the movement of the second switching unit 63 by way of example.

Meanwhile, in order to maintain a state in which the door 3 is coupled to the first rotational axis X when the door 3 closes the introduction port 111, the rotational axis switching unit 6 may be further provided with an elastic support unit to push the first switching unit 61 toward first shaft attaching and detaching unit 513.

The elastic support unit may include only a second support unit 635 to elastically support the second switching unit 63. Alternatively, the elastic support unit may further include a first support unit 615 to elastically support the first switching unit 61 in addition to the second support unit 635.

The second support unit 635 pushes the first free end 63*e* of the second switching unit 63 in a direction in which the first free end 63*e* of the second switching unit 63 moves away from the switching unit receiving unit 557, and the first support unit 615 pushes the first free end 61*e* of the first switching unit 61 in a direction in which the first free end 61*e* of the first switching unit 61 closes the first shaft receiving unit 513*b*.

Consequently, in a case in which through the manipulation unit 4 does not move the first switching unit 61 in a direction in which the first switching unit 61 pushes the second switching unit 63 (i.e. when the user does not manipulate the manipulation unit 4), the first free end 63*e* of the second switching unit 63 remains withdrawn from the switching unit receiving unit 557.

In a case in which the first free end 63*e* of the second switching unit 63 remains withdrawn from the switching unit receiving unit 557 by the second support unit 635, the second free end 61*f* of the first switching unit 61 is pushed toward the first shaft attaching and detaching unit 513 by the second free end 63*f* of the second switching unit 63. As a result, the first shaft 511*b* is prevented from being withdrawn from the first shaft receiving unit 513*b* by the first free end 61*e* of the first switching unit 61.

In the present invention, therefore, the door 3 remains rotatable about the first rotational axis X unless the user manipulates the manipulation unit 4 in a state in which the introduction port 111 is closed by the door 3.

The reason that the door 3 remains rotatable about the first rotational axis X in a state in which the introduction port 111 is closed by the door 3 is that it is advantageous to prevent the door 3 from opening the introduction port 111 due to the weight of the door 3 when the door 3 remains coupled to the first rotational axis X.

That is, in a case in which the door 3 remains connected to the second rotational axis Y when the introduction port 111 is closed by the door 3, the door 3 may be rotated about the second rotational axis Y since a direction in which gravity is applied to the door 3 is similar to a direction in which the door 3 is rotated about the second rotational axis Y. In a case in which the door 3 remains coupled to the first rotational axis X when the introduction port 111 is closed by the door 3, on the other hand, the above-mentioned problem may be prevented.

The second support unit 635 may be configured as a spring having one end fixed to the second switching unit 63 and the other end fixed to either one selected from between the outer frame 311 and the inner frame 312. In the same manner, the first support unit 615 may be configured as a spring having one end fixed to the first switching unit 61 and the other end fixed to either one selected from between the outer frame 311 and the inner frame 312.

Hereinafter, switching between the rotational axes X and Y of the door 3 will be described with reference to FIGS. 5 and 6.

In a case in which the introduction port 111 is closed by the door 3 (i.e. in a case in which the door body 31 contacts the front panel 11 or in a case in which the handle body 41 is not pushed), the first switching unit 61 is pushed toward the first hinge 51 by the elastic support units 615 and 635. As a result, the first free end 61*e* of the first switching unit 61 prevents the first shaft 511*b* from being withdrawn from the first shaft receiving unit 513*b*.

Figure 5:
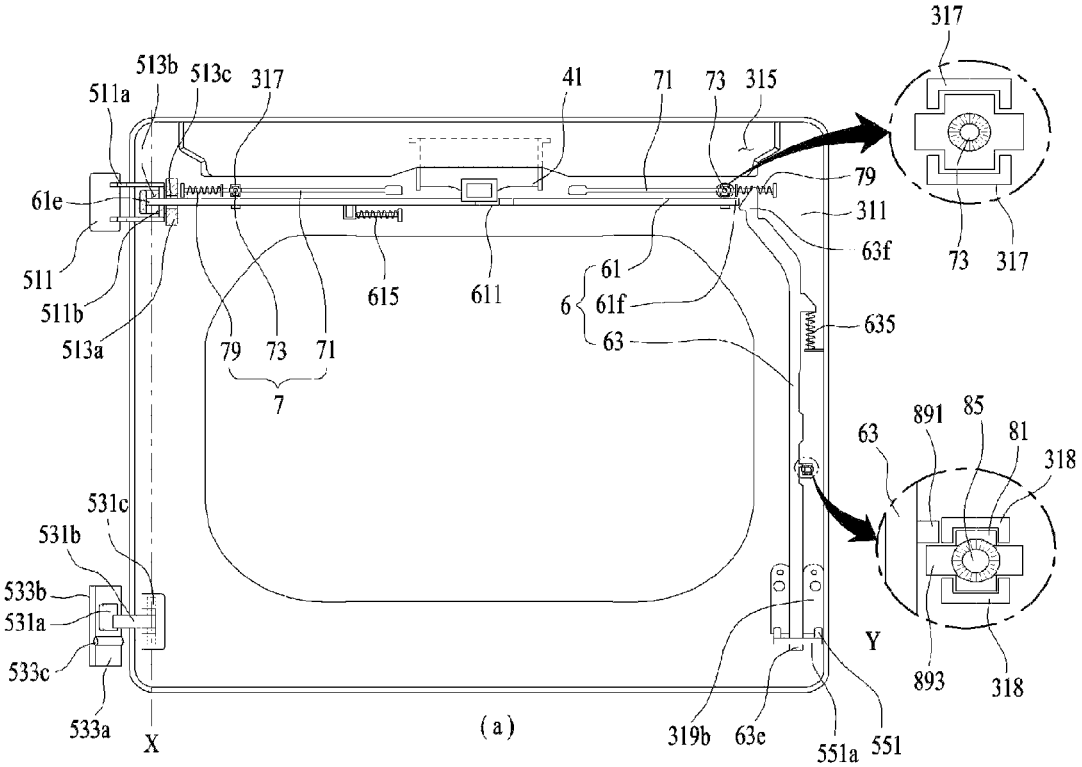

At this time, the fourth shaft 551*a* remains inserted in the fourth shaft receiving unit 555, but the first free end 63*e* of the second switching unit 63 is not inserted through the flange through hole 557*b* (see FIG. 5(*b*)). This is because the second switching unit 63 is not inserted through the flange through hole 557*b* unless the first switching unit 61 is moved by the manipulation unit 4 in a direction in which the first switching unit 61 moves away from the first hinge 51 (in the rightward direction of FIG. 5(*a*)).

In a case in which the introduction port 111 is closed by the door 3, therefore, the door 3 may be rotated about the first rotational axis X defined by the first shaft 511*b* and the second shaft 531*c*.

At this time, when the user pulls the door body 31 away from the front panel 11 using the receiving unit 315 (i.e. when the user pulls the door body 31 without pushing the handle body 41), the door 3 is rotated about the first rotational axis X to open the introduction port 111 (see FIG. 3).

Figure 6:
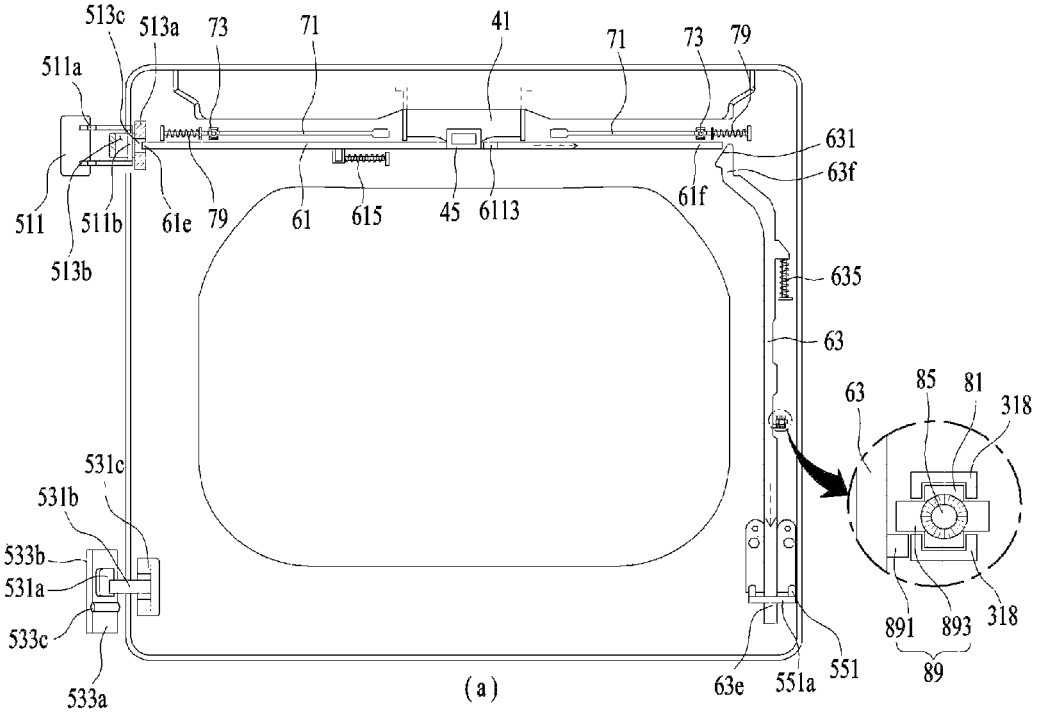
Figure 6:
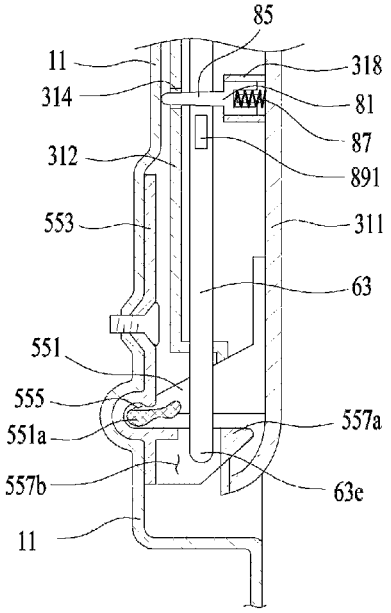

When the user pushes the handle body 4 in a state in which the introduction port 111 is closed by the door 3, on the other hand, the first switching unit 61 and the second switching unit 63 perform movement as shown in FIG. 6(*a*). That is, when the user pushes the handle body 41, the transfer unit 45 pushes the tilted surface 6113 provided at the contact unit 611. As a result, the first switching unit 61 moves toward the second switching unit 63.

When the first switching unit 61 moves toward the second switching unit 63, the first free end 61*e* of the first switching unit 61 moves toward the interior of the door body 31, and the second free end 61*f* of the first switching unit 61 pushes the tilted switching unit surface 631 of the second switching unit 63. Consequently, the first shaft 511*b* is withdrawn from the first shaft receiving unit 513*b*, and the first free end 63*e* of the second switching unit 63 is inserted through the flange through hole 557*b* of the third hinge 55. As a result, the fourth shaft 551*a* is prevented from being separated from the fourth shaft receiving unit 555 (see FIG. 6(*b*)).

That is, when the user pushes the handle body 41 in a state in which the introduction port 111 is closed by the door 3, the door 3 may be rotated about the second rotational axis Y defined by the fourth shaft 551*a* and the third shaft 533*c*.

At this time, when the user pulls the door body 31 away from the front panel 11 while pushing the handle body 41, the door 3 is rotated about the second rotational axis Y to open the introduction port 111 (a state of FIG. 1).

In the laundry treating apparatus 100 as described above, the first rotational axis X may be a vertical axis perpendicular to the bottom of the cabinet 1, and the second rotational axis Y may be a horizontal axis parallel to the bottom of the cabinet 1. However, the present invention is not limited thereto.

Meanwhile, in the laundry treating apparatus 100 having only the above-described structure, the first shaft 511*b* may be separated from the first shaft attaching and detaching unit 513 in a case in which the user pushes the handle body 41 when the door body 31 is rotated about the first rotational axis X.

In addition, in the laundry treating apparatus 100 having only the above-described structure, the handle body 41 must be kept pushed, when the door body 31 is rotated about the second rotational axis Y, in order to prevent the fourth shaft 551*a* from being separated from the fourth shaft receiving unit 555.

In order to solve the above problems, therefore, the laundry treating apparatus 100 according to the present invention may further include a position fixing unit 7 and 8 to fix the positions of the first switching unit 61 and the second switching unit 63 when the introduction port 111 is opened by the door 3 (i.e. when the door body 31 is separated from the front panel 11).

FIGS. 5 and 6 are views showing a case in which the position fixing unit includes both a first lock 7 to fix the position of the first switching unit 61 and a second lock 8 to fix the position of the second switching unit 63 by way of example.

Figure 7:
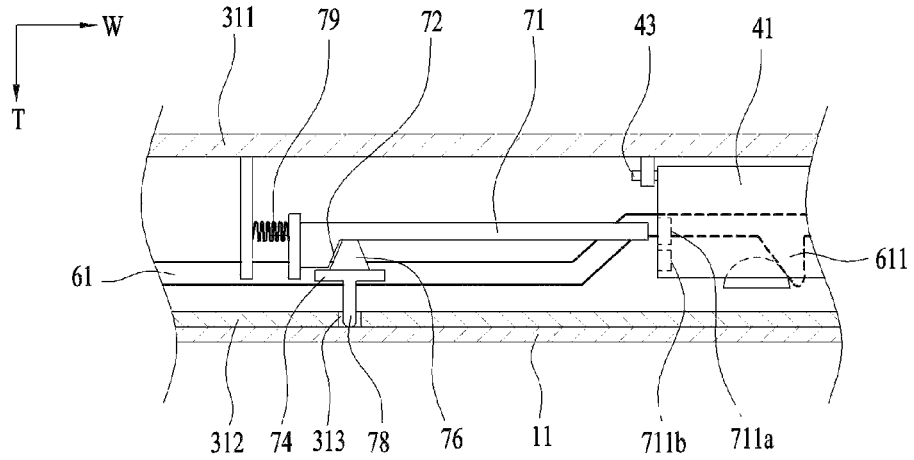
FIG. 7 is a view showing the first lock.
Figure 7:
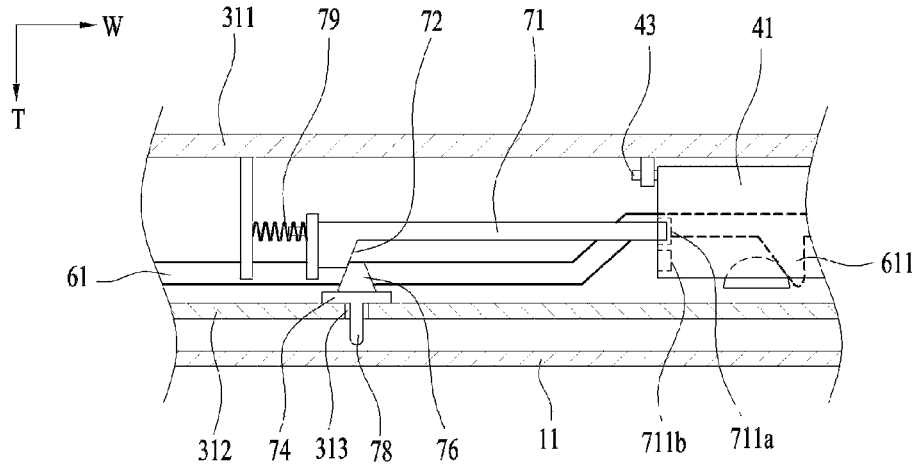

As shown in FIG. 7(*a*), the first lock 7 may include a first lock body 71 detachably provided at the manipulation unit 4 and a first lock transfer unit 73 to reciprocate the first lock body 71 in the door body 31 in a width direction W of the door 3.

The first lock body 71 may be formed in the shape of a bar. The first lock body 71 is elastically supported by a first lock support unit 79. The first lock support unit 79 may be configured as a spring configured to push a free end of the first lock body 71 toward the manipulation unit 4 while fixing the first lock body 71 to the door body 31.

The first lock body 71 is provided with a tilted first lock surface 72, which is pushed by the first lock transfer unit 73. The tilted first lock surface 72 may be tilted away from the manipulation unit 4 as the tilted first lock surface 72 becomes more distant from the first lock body 71 (i.e. as the tilted first lock surface 72 becomes closer to the inner frame 312).

The first lock transfer unit 73 is a means for moving the first lock body 71 in a direction in which the first lock body 71 becomes more distant from the handle body 41 when the introduction port 111 is closed by the door 3 and for moving the first lock body 71 in a direction in which the first lock body 71 becomes closer to the handle body 41 when the introduction port 111 is opened by the door 3.

To this end, the first lock transfer unit 73 may include a transfer body 74 configured to reciprocate in a thickness direction T of the door 3 and a push unit 76 and 78 to separate the first lock body 71 from the manipulation unit 4 when coming into contact with the front panel 11.

The door body 31 may further include a first guide 317 (see FIG. 5) to guide the movement of the transfer body 74.

The push unit may include a first push unit 78 fixed to the transfer body 74, the first push unit 78 being inserted through the inner frame 312, and a second push unit 76 fixed to the transfer body 74, the second push unit 76 contacting the tilted first lock surface 72. In this case, the inner frame 312 may be further provided with a through hole (a second through hole) 313, through which the first push unit 78 is inserted.

Unlike what is shown in the figures, however, the first lock transfer unit 73 may be fixed to the front panel 11. In this case, the first lock transfer unit 73 may be inserted through the through hole (the second through hole) 313 to push the tilted first lock surface 72 when the introduction port 111 is closed by the door 3.

Meanwhile, the first lock body 71 may be coupled to the handle body 41 via a first lock fastening unit 711*a* and 711*b*. In this case, the first lock fastening unit may include a first fixing unit 711*a* and a second fixing unit 711*b* provided at the handle body 41 to receive a free end of the first lock body 71.

When the user rotates the door 3 without pushing the manipulation unit 4 (i.e. when the door 3 is rotated about the first rotational axis X), the first lock body 71 is coupled to the first fixing unit 711*a*. When the user rotates the door 3 while pushing the manipulation unit 4 (i.e. when the door 3 is rotated about the second rotational axis Y), the first lock body 71 is coupled to the second fixing unit 711*b*.

Figure 8:
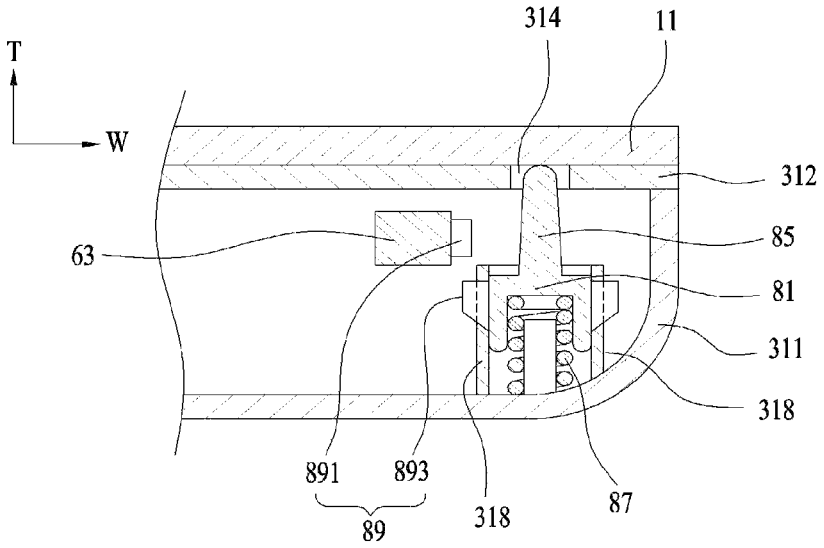
FIG. 8 is a view showing the second lock.
Figure 8:
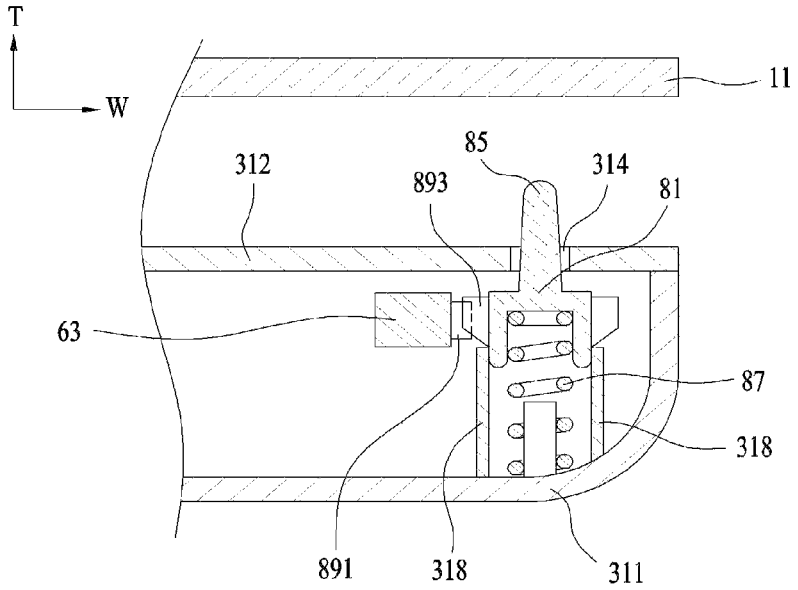

As shown in FIG. 8, the second lock 8 may include a second lock body 81 configured to reciprocate in the door 3 in the thickness direction T of the door 3, a second lock support unit 87 to elastically support the second lock body 81, a second lock transfer unit 85 to move the second lock body 81 in a direction in which the second lock body 81 becomes more distant from the front panel 11 when the introduction port 111 is closed by the door 3, and a second lock fastening unit 89 to separate the second lock body 81 from the second switching unit 63 when the introduction port 111 is closed by the door 3 and to couple the second lock body 81 to the second switching unit 63 when the introduction port 111 is opened by the door 3.

The second lock body 81 is reciprocated in the door 3 while being guided by a second guide 318 provided in the door body 31.

The second lock support unit 87 may be configured as a spring connecting the second lock body 81 with the door body 31. In this case, the second lock support unit 87 may push the second lock body 81 toward the inner frame 312 (i.e. toward the introduction port 111).

The second lock transfer unit 85 may be fixed to the second lock body 81 through the inner frame 312. In this case, the inner frame 312 may be further provided with a through hole (a first through hole) 314, through which the second lock transfer unit 85 is inserted.

Alternatively, the second lock transfer unit 85 may be fixed to the front panel 11. In this case, when the introduction port 111 is closed by the door body 31, the second lock transfer unit 85 may be inserted through the through hole (the first through hole) 314 to push the second lock body 81.

The second lock fastening unit 89 may include a first fastening unit 891 provided at the second switching unit 63 and a second fastening unit 893 provided at the second lock body 81 such that the second fastening unit 893 is detachably coupled to the first fastening unit 891.

The shape of the second lock fastening unit 89 is not particularly restricted so long as the second lock fastening unit 89 performs the above-described functions. FIG. 8 is a view showing a case in which the first fastening unit 891 protrudes from the outer circumference of the second switching unit 63, and the second fastening unit 893 protrudes from the outer circumference of the second lock body 81 to support the first fastening unit 891 based on the position of the second switching unit 63, by way of example.

Hereinafter, the operation of the door 3, which has the position fixing unit 7 and 8, will be described with reference to FIGS. 7, 8, 9, and 10.

When the introduction port 111 is closed by the door body 31, the first lock transfer unit 73 and the second lock transfer unit 85 are pushed by the front panel 11. As a result, the first lock body 71 remains separated from the manipulation unit 4 (see FIG. 7(*a*)), and the second fastening unit 893 of the second lock body 81 remains separated from the first fastening unit 891 (see FIG. 8(*a*)).

Figure 9:
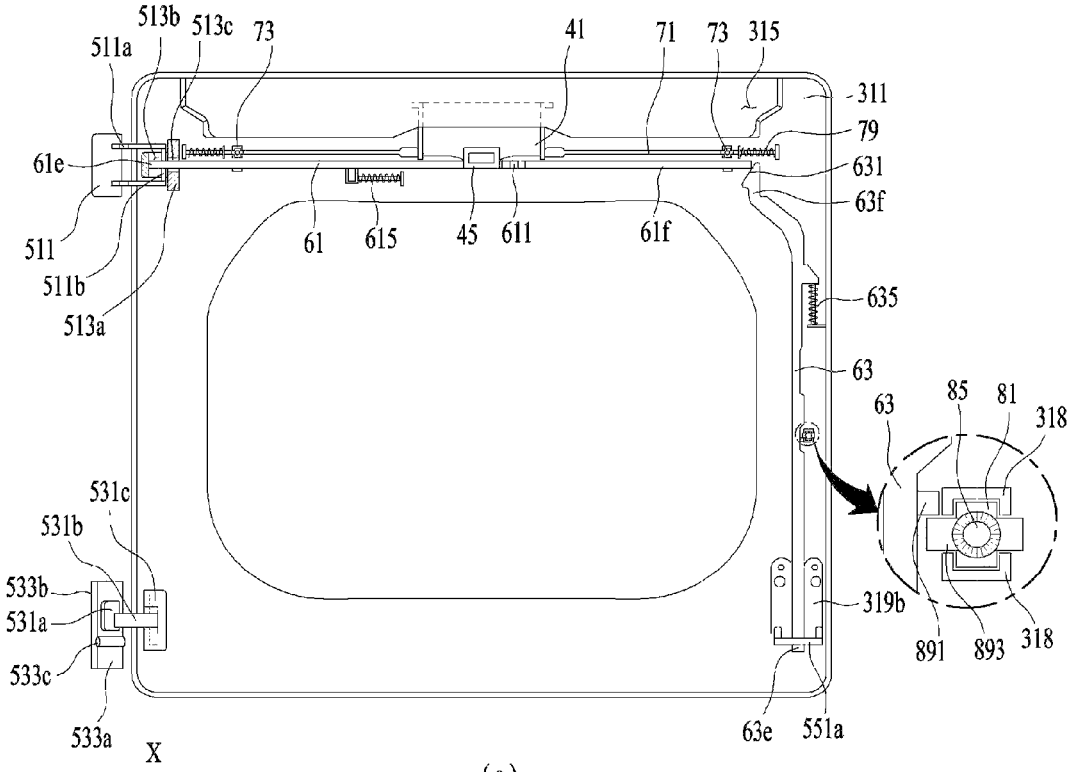
FIGS. 9 and 10 are views showing the positions of the rotational axis switching unit, the first lock, and the second lock when the introduction port is opened by the door.
Figure 9:
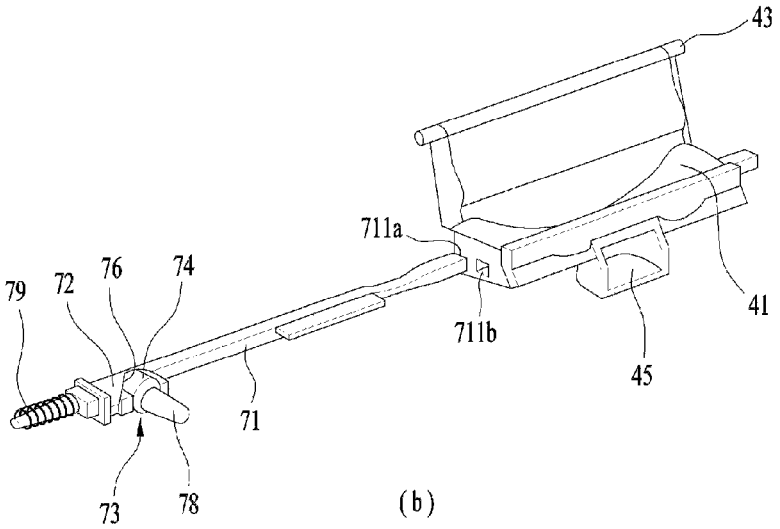

When the user separates the door body 31 from the front panel 11 (i.e. when the user rotates the door body 31 about the first rotational axis X) without pushing the manipulation unit 4 in this state, the rotational axis switching unit 6, the first lock 7, and the second lock 8 are operated as shown in FIG. 9.

That is, external force applied from the front panel 11 to the first lock transfer unit 73 and the second lock transfer unit 85 is removed. As a result, the first lock body 71 is coupled to the first fixing unit 711*a* to prevent the rotation of the handle body 41 (see FIG. 9(*b*)), and the second fastening unit 893 of the second lock body 81 moves upward to the side of the first fastening unit 891 (see FIG. 8(*b*)) to prevent the movement of the second switching unit 63 toward the fourth shaft 551*a*.

As the rotation of the handle body 41 is prevented by the first fixing unit 711*a*, the first switching unit 61 does not move even when external force is applied to the handle body 41 while the door body 31 is rotated about the first rotational axis X. In the present invention, therefore, it is possible to prevent the first shaft 511*b* from being separated from the first shaft receiving unit 513*b* even when external force is applied to the handle body 41 while the door body 31 is rotated about the first rotational axis X.

Meanwhile, the first lock transfer unit 73 may be pushed by the user or any object while the door body 31 is rotated about the first rotational axis X with the result that the handle body 41 may be rotated. In the present invention, however, it is possible for the second lock 8 to prevent the first shaft 511*b* from being separated from the first shaft receiving unit 513*b*.

Assuming that the second lock 8 is not provided, when the first lock transfer unit 73 is pushed by the user or any object while the door body 31 is rotated about the first rotational axis X, the first lock body 71 is separated from the first fixing unit 711*a* of the manipulation unit 4. At this time, when the user pushes the handle body 41, the first free end 61*e* of the first switching unit 61 opens the first shaft receiving unit 513*b*. As a result, the door body 31 is separated from both the first rotational axis X and the second rotational axis Y (the first shaft is separated from the first shaft receiving unit 513*b*, and the fourth shaft is separated from the fourth shaft receiving unit 555.

In the present invention, however, when the door body 31 is separated from the front panel 11 (i.e. when the external force applied to the second lock transfer unit 85 is removed), the movement of the second switching unit 63 toward the fourth shaft 551*a* is prevented by the second lock 8, and therefore the movement of the first switching unit 61, which is supported by the second free end 63*f* of the second switching unit 63, is also prevented by the second lock 8.

In the present invention, therefore, it is possible for the second lock 8 to prevent the door body 31 from being separated from the first shaft 511*b* even when external force is applied to the first lock transfer unit 73 while the door body 31 is rotated about the first rotational axis X.

Figure 10:
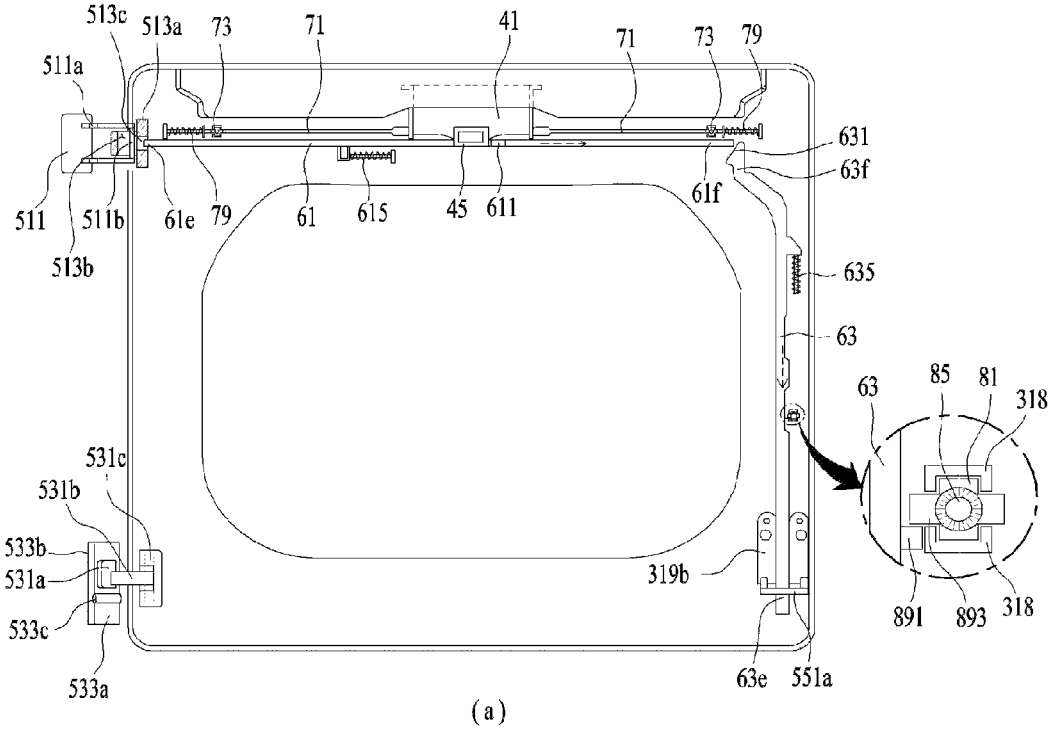
Figure 10:
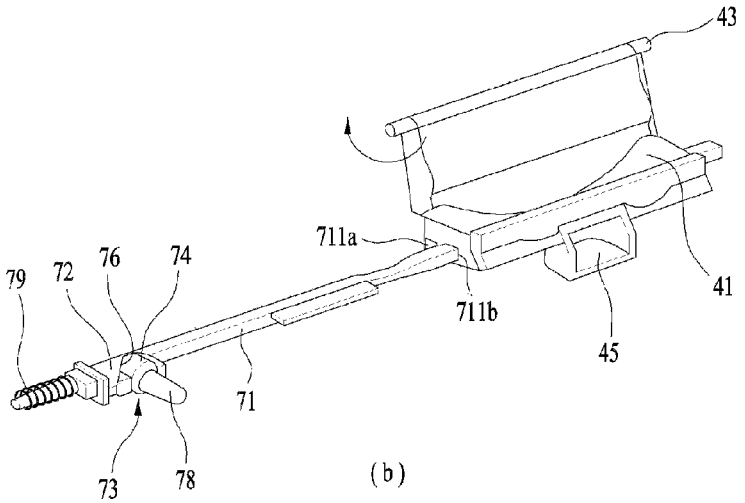

On the other hand, when the user pushes the manipulation unit 4 and then separates the door body 31 from the front panel 11 (i.e. when the user rotates the door body 31 about the first rotational axis X), the rotational axis switching unit 6, the first lock 7, and the second lock 8 are operated as shown in FIG. 10.

That is, the first switching unit 61 moves in a direction in which the first shaft receiving unit 513*b* is opened. As a result, the second free end 63*f* of the second switching unit 63 is inserted through the flange through hole 557*b* to prevent the fourth shaft 551*a* from being separated from the fourth shaft receiving unit 555.

In addition, the first lock transfer unit 73 and the second lock transfer unit 85 are separated from the front panel 11. As a result, the first lock body 71 is coupled to the second fixing unit 711*b* to prevent the rotation of the handle body 41, and the second fastening unit 893 of the second lock body 81 moves upward to the side of the first fastening unit 891 to prevent the movement of the second switching unit 63 toward the second free end 61*f* of the first switching unit 61.

As the first lock body 71 is coupled to the second fixing unit 711*b*, the handle body 41 is kept rotated (i.e. the transfer unit 45, which is provided at the manipulation unit 4, keeps pushing the contact unit 611 of the first switching unit 61). In the present invention, therefore, it is possible to prevent the fourth shaft 551*a* from being separated from the fourth shaft receiving unit 555 even when the user keeps pushing the handle body 41 while the door body 31 is rotated about the second rotational axis Y.

Meanwhile, in a case in which only the first lock 7 is provided at the door 3, the fourth shaft 551*a* may be separated from the fourth shaft receiving unit 555 when the first lock transfer unit 73 is pushed while the door body 31 is rotated about the second rotational axis Y. In the present invention, however, it is possible for the second lock 8 to prevent the fourth shaft 551*a* from being separated from the fourth shaft receiving unit 555.

Assuming that the second lock 8 is not provided, when the first lock transfer unit 73 is pushed by the user or any object while the door body 31 is rotated about the second rotational axis Y, the first lock body 71 is separated from the second fixing unit 711*b* of the handle body 414.

When the first lock body 71 is separated from the second fixing unit 711*b*, external force applied to the contact unit 611 of the first switching unit 61 through the transfer unit 45 of the manipulation unit 4 is removed. As a result, the first free end 61*e* of the first switching unit 61 is moved to the first shaft attaching and detaching unit 513 by the elastic support units 615 and 635, and the first free end 63*e* of the second switching unit 63 is moved in a direction in which the first free end 63*e* of the second switching unit 63 moves away from the fourth shaft 551*a*. Consequently, the fourth shaft 551*a* is separated from the fourth shaft receiving unit 555.

In the present invention, however, the second lock 8 prevents the second switching unit 63 from being moved in a direction in which the second switching unit 63 moves away from the fourth shaft 551*a* while the door body 31 is rotated about the second rotational axis Y. In the present invention, therefore, it is possible for the second lock 8 to prevent the fourth shaft 551*a* from being separated from the fourth shaft receiving unit 555 even when external force is applied to the first lock transfer unit 73 while the door body 31 is rotated about the second rotational axis Y.

In conclusion, in a case in which both the first lock 7 and the second lock 8 are provided at the door 3, it is possible to switch between the rotational axes X and Y only when external force is applied to both the first lock transfer unit 73 and the second lock transfer unit 85. Consequently, it is possible to prevent the door body 31 from being separated from both the first hinge 51 and the third hinge 55 even when external force is applied to any one of the lock transfer units during the rotation of the door body 31.

Figure 11:
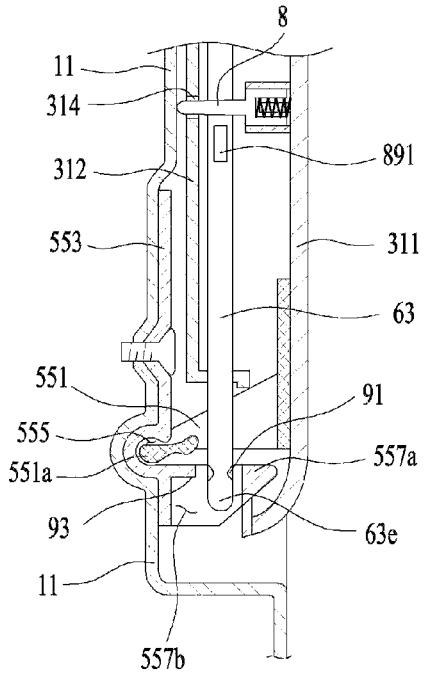
FIG. 11 is a view showing a withdrawal prevention unit.
Figure 11:
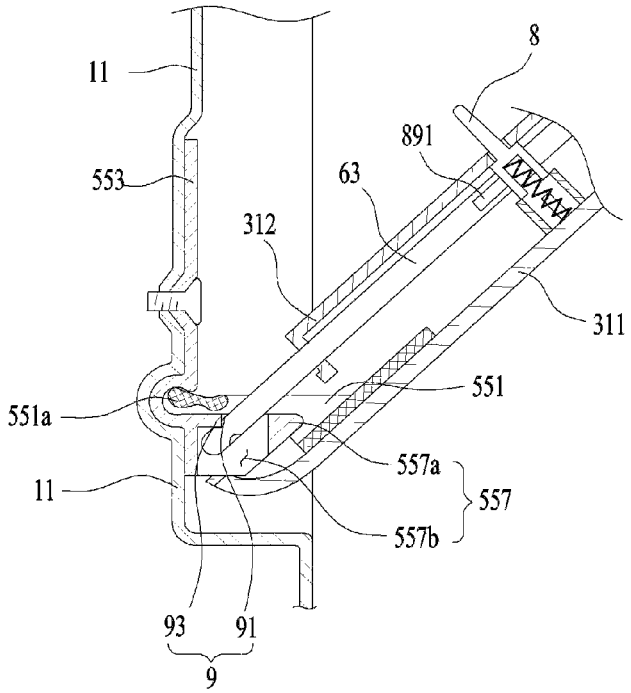

Meanwhile, the effects obtained by the second lock 8 may also be obtained by a withdrawal prevention unit 9 shown in FIG. 11.

As shown in FIG. 11, the withdrawal prevention unit 9 may include a first withdrawal prevention unit 91 provided at the second switching unit 63 and a second withdrawal prevention unit 91 provided at the fourth shaft attaching and detaching unit 552 such that the second withdrawal prevention unit 91 is detachably coupled to the second switching unit 63.

The first withdrawal prevention unit 91 may be configured as a groove formed in the outer circumference of the second switching unit 63. In this case, the second withdrawal prevention unit 91 may be configured as a protrusion provided at the inside of the flange through hole 557*b* such that the second withdrawal prevention unit 91 is inserted into the first withdrawal prevention unit 91.

In a case in which the withdrawal prevention unit 9 is provided as described above, it is possible to prevent the second switching unit 63 from being separated from the flange through hole 557*b* even when external force is applied to the first lock transfer unit 73 while the door body 31 is rotated about the second rotational axis Y.

In the present invention, therefore, it is possible to prevent the fourth shaft 551*a* from being separated from the fourth shaft receiving unit 555 even when external force is applied to the first lock transfer unit 73 while the door body 31 is rotated about the second rotational axis Y.

The laundry treating apparatus 100 according to the present invention may include only the withdrawal prevention unit 9, excluding the first lock 7 and the second lock 8. Alternatively, the laundry treating apparatus 100 according to the present invention may include the first lock 7 and either one selected from between the second lock 8 and the withdrawal prevention unit 9. Alternatively, the laundry treating apparatus 100 according to the present invention may include all of the first lock 7, the second lock 8, and the withdrawal prevention unit 9.

Figure 12:
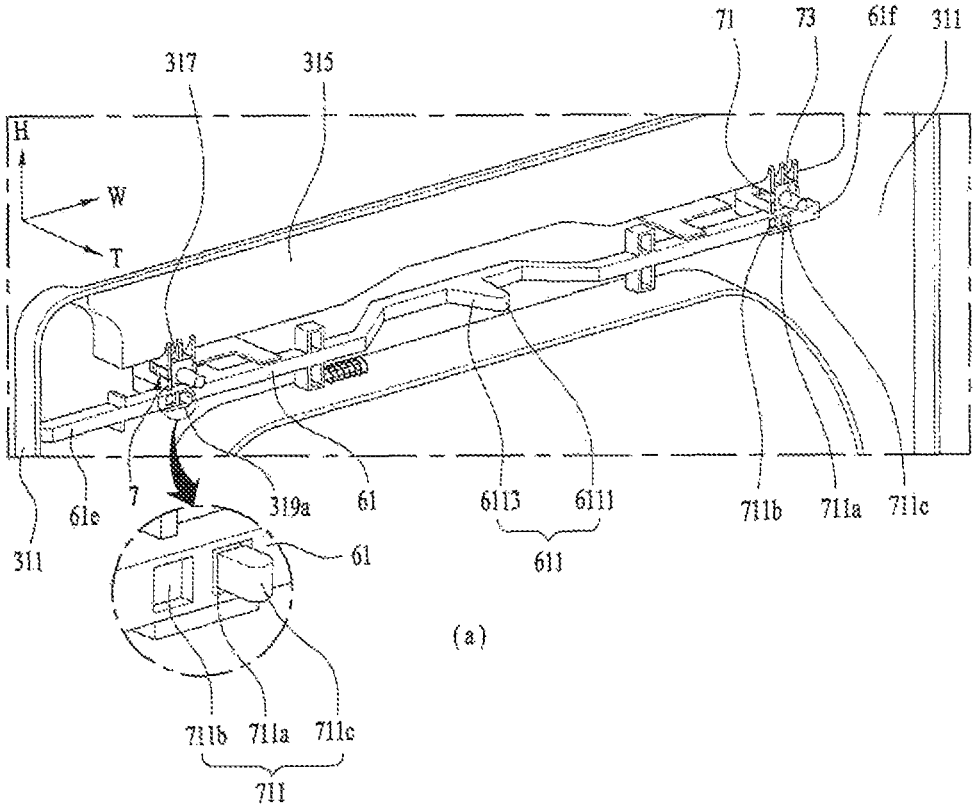
FIG. 12 is a view showing another embodiment of the first lock.
Figure 12:
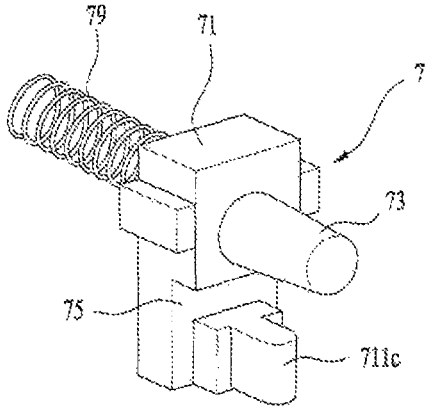

FIG. 12 is a view showing another embodiment of the first lock 7.

The first lock 7 according to the previous embodiment is coupled to the manipulation unit 4 to fix the position of the first switching unit 61, whereas the first lock 7 according to this embodiment is detachably provided at the first switching unit 61 to fix the position of the first switching unit 61.

That is, the first lock 7 according to this embodiment may include a first lock body 71 configured to reciprocate in the thickness direction T of the door 3, a first lock support unit 79 to elastically support the first lock body 71, a first lock transfer unit 73 to move the first lock body 71 in a direction in which the first lock body 71 becomes more distant from the first switching unit 61 when the introduction port 111 is closed by the door body 31, and a first lock fastening unit 711 to couple the first lock body 71 to the first switching unit 61 based on whether the first lock transfer unit 73 contacts the front panel 11.

The first lock body 71 is reciprocated in the door 3 while being guided by the first guide 317, which is provided at the outer frame 311.

The first lock support unit 79 may be configured as a spring connecting the first lock body 71 with the outer frame 311 to push the first lock body 71 toward the inner frame 312.

The first lock transfer unit 73 protrudes from the first lock body 71 such that the first lock transfer unit 73 is exposed out of the door body 31 through the through hole (the second through hole) 313 (see FIG. 7), which is provided in the inner frame 312.

The first lock fastening unit 711 is a means for separating the first lock body 71 from the first switching unit 61 when the introduction port 111 is closed by the door body 31 and for fixing the first lock body 71 to the first switching unit 61 when the introduction port 111 is opened by the door body 31.

To this end, the first lock fastening unit 711 may include a first fixing unit 711*a* and a second fixing unit 711*b* spaced apart from each other by a predetermined distance in a longitudinal direction W of the first switching unit 61 and a third fixing unit 711*c* provided at the first lock body 71 such that the third fixing unit 711*c* is inserted into either one selected from between the first fixing unit 711*a* and the second fixing unit 711*b*.

In this case, the third fixing unit 711*c* may be provided at a first lock flange 75 extending from the first lock body 71 toward a space defined between the first switching unit 61 and the outer frame 311.

In this embodiment, the first shaft 511*b* is prevented from being separated from the first shaft receiving unit 513*b* when the third fixing unit 711*c* is inserted into the first fixing unit 711*a*, and the fourth shaft 551*a* is prevented from being withdrawn from the fourth shaft receiving unit 555 when the third fixing unit 711*c* is inserted into the second fixing unit 711*b*.

Figure 13:
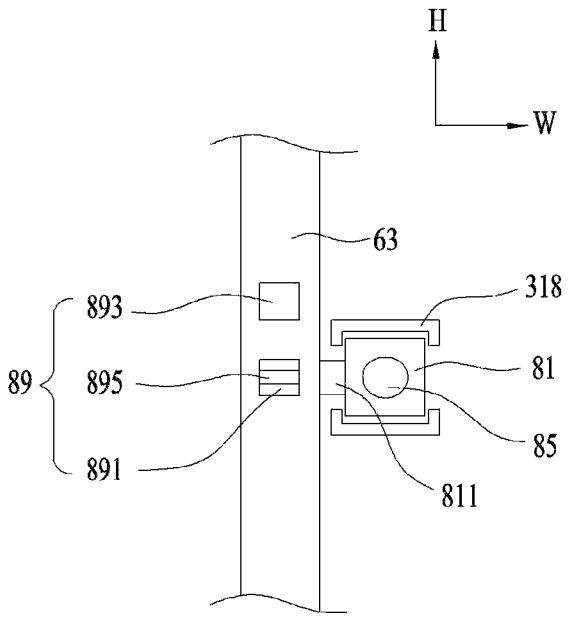
FIG. 13 is a view showing another embodiment of the second lock.
Figure 13:
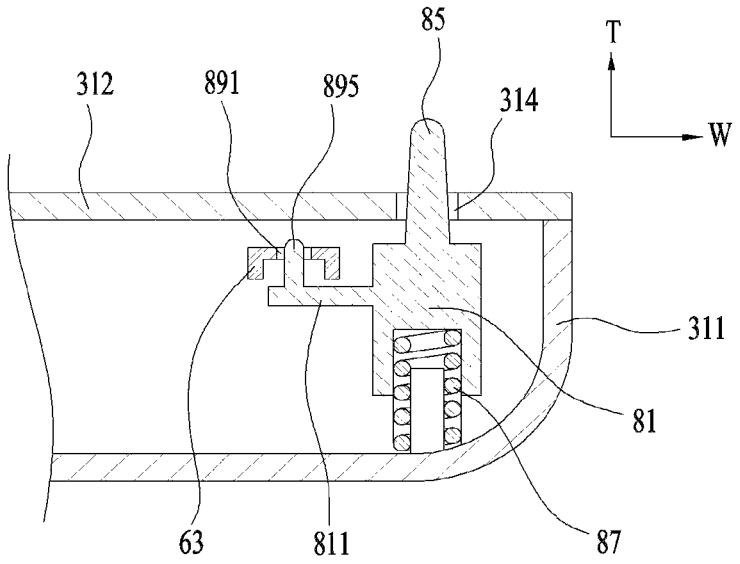

FIG. 13 is a view showing another embodiment of the second lock 8.

The second lock 8 according to the previous embodiment may include a second lock body 81 configured to reciprocate in the thickness direction T of the door 3, a second lock support unit 87 to elastically support the second lock body 81, a second lock transfer unit 85 to move the second lock body 81 in a direction in which the second lock body 81 becomes more distant from the second switching unit 63 when the introduction port 111 is closed by the door body 31, and a second lock fastening unit 89 to couple the second lock body 81 to the second switching unit 63 based on whether the second lock transfer unit 85 contacts the front panel 11.

The second lock transfer unit 85 protrudes from the second lock body 81 such that the second lock transfer unit 85 is exposed out of the door body 31 through the through hole 314, which is provided in the inner frame 312.

The second lock fastening unit 89 is a means for separating the second lock body 81 from the second switching unit 63 when the introduction port 111 is closed by the door body 31 and for fixing the second lock body 81 to the second switching unit 63 when the introduction port 111 is opened by the door body 31.

The second lock fastening unit 89 may include a first fastening unit 891 and a second fastening unit 893 spaced apart from each other by a predetermined distance in a longitudinal direction H of the second switching unit 63 (in a height direction of the door 3) and a third fastening unit 895 provided at the second lock body 81 such that the third fastening unit 895 is inserted into either one selected from between the first fastening unit 891 and the second fastening unit 893.

In this case, the third fastening unit 895 may be provided at a second lock flange 811 extending from the second lock body 81 toward a space defined between the second switching unit 63 and the outer frame 311.

In this embodiment, the first shaft 511*b* is prevented from being separated from the first shaft receiving unit 513*b* when the third fastening unit 895 is inserted into the first fastening unit 891, and the fourth shaft 551*a* is prevented from being withdrawn from the fourth shaft receiving unit 555 when the third fastening unit 895 is inserted into the second fastening unit 893.

As is apparent from the above description, the present invention has the effect of providing a laundry treating apparatus configured such that a door is rotated in different directions to open an introduction port, through which laundry is introduced.

In addition, the present invention has the effect of providing a laundry treating apparatus that enables a user to switch between rotational axes of a door.

In addition, the present invention has the effect of providing a laundry treating apparatus that prevents switching between rotational axes of a door while the door opens an introduction port.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry treating apparatus comprising:

a cabinet having an introduction port;

a laundry receiving unit located in the cabinet to receive laundry introduced through the introduction port;

a door configured to open and close the introduction port;

a first hinge comprising a first shaft provided at either one selected from between the cabinet and the door to define a first rotational axis of the door and a first shaft receiving unit provided at the other one selected from between the cabinet and the door such that the first shaft is detachably received in the first shaft receiving unit;

a second hinge comprising a second shaft coupled to the door to define the first rotational axis together with the first shaft and a third shaft configured to rotatably fix the second shaft to the cabinet and to define a second rotational axis of the door;

a third hinge comprising a fourth shaft provided at either one selected from between the cabinet and the door to define the second rotational axis together with the third shaft and a fourth shaft receiving unit provided at the other one selected from between the cabinet and the door such that the fourth shaft is detachably received in the fourth shaft receiving unit;

a first switching unit provided in the door in a reciprocating fashion to open and close the first shaft receiving unit;

a second switching unit provided in the door in a reciprocating fashion to open and close the fourth shaft receiving unit, the second switching unit being configured to close the fourth shaft receiving unit when the first switching unit moves in a direction in which the first shaft receiving unit is opened; and a withdrawal prevention unit configured to detachably couple the second switching unit to the third hinge when the second switching unit closes the fourth shaft receiving unit.

2. The laundry treating apparatus according to claim 1, wherein the third hinge further comprises a switching unit receiving unit, into which a free end of the second switching unit to close the fourth shaft receiving unit is inserted, and the withdrawal prevention unit comprises: a first withdrawal prevention unit provided at either one selected from between the second switching unit and the switching unit receiving unit and a second withdrawal prevention unit provided at the other one selected from between the second switching unit and the switching unit receiving unit such that the second withdrawal prevention unit is detachably coupled to the first withdrawal prevention unit.

3. The laundry treating apparatus according to claim 2, wherein the first withdrawal prevention unit is configured as a groove formed in an outer circumference of the second switching unit, and the second withdrawal prevention unit is configured as a protrusion, which is inserted into the groove.

4. The laundry treating apparatus according to claim 3, further comprising:

a manipulation unit configured to move the first switching unit;

a first lock configured to fix a position of the first switching unit when the door opens the introduction port; and a second lock configured to fix a position of the second switching unit when the door opens the introduction port.

5. The laundry treating apparatus according to claim 4, wherein the second lock is configured to be separated from the second switching unit when the door closes the introduction port and to be coupled to the second switching unit when the door opens the introduction port.

6. The laundry treating apparatus according to claim 5, wherein the second lock comprises:

a second lock body configured to reciprocate in the door in a thickness direction of the door;

a second lock transfer unit configured to move the second lock body in a direction in which the second lock body becomes more distant from the introduction port when the door closes the introduction port;

a second lock support unit configured to elastically support the second lock body such that the second lock body is pushed toward the introduction port; and a second lock fastening unit configured to separate the second lock body from the second switching unit when the door closes the introduction port and to connect the second lock body to the second switching unit when the door opens the introduction port.

7. The laundry treating apparatus according to claim 6, wherein the second lock fastening unit comprises:

a first fastening unit provided at the second switching unit; and a second fastening unit provided at the second lock body such that the second fastening unit is coupled to the first fastening unit.

8. The laundry treating apparatus according to claim 6, wherein the second lock fastening unit comprises:

a first fastening unit and a second fastening unit provided at the second switching unit, the first fastening unit and the second fastening unit being spaced apart from each other by a predetermined distance in a direction in which the second switching unit is moved;

a second lock flange protruding from the second lock body toward the second switching unit; and a third fastening unit provided at the second lock flange such that the third fastening unit is coupled to either one selected from between the first fastening unit and the second fastening unit based on a position of the second switching unit.

9. The laundry treating apparatus according to claim 4, wherein the first lock comprises:

a first lock body configured to reciprocate in a width direction of the door, the first lock body being detachably provided at the manipulation unit;

a first lock support unit configured to elastically support the first lock body; and a first lock transfer unit configured to separate the first lock body from the manipulation unit when the door closes the introduction port and to couple the first lock body to the manipulation unit when the door opens the introduction port.

10. The laundry treating apparatus according to claim 4, wherein the first lock comprises:

a first lock body configured to reciprocate in the door in a thickness direction of the door;

a second lock transfer unit configured to move the first lock body in a direction in which the first lock body becomes more distant from the introduction port while contacting the cabinet when the door closes the introduction port;

a first lock support unit configured to elastically support the first lock body such that the first lock body is pushed toward the introduction port;

a first fixing unit and a second fixing unit spaced apart from each other by a predetermined distance in a direction in which the first switching unit is moved;

a first lock flange provided at the first lock body; and a third fixing unit provided at the first lock flange such that the third fixing unit is coupled to either one selected from between the first fixing unit and the second fixing unit based on a position of the first switching unit.

* * * * *